US005569124A

United States Patent [19]

Raynie et al.

[11] Patent Number: 5,569,124

[45] **Date of Patent: *Oct. 29, 1996**

[54] ARM, HAND AND WRIST EXERCISING DEVICE

[75] Inventors: Arthur D. Raynie; David L. Robertson, both of San Antonio, Tex.

[73] Assignee: Mediflex Systems, Inc., San Antonio, Tex.

[ * ] Notice: The term of this patent shall not extend beyond the expiration date of Pat. No. 5,380,259.

[21] Appl. No.: 370,401

[22] Filed: Jan. 9, 1995

Related U.S. Application Data

[63] Continuation-in-part of Ser. No. 135,894, Oct. 13, 1993, Pat. No. 5,380,259.

[51] Int. Cl.[6] ..... A63B 23/14

[52] U.S. Cl. ..... 482/44; 482/45; 482/123; 482/128; 482/908; 601/40

[58] Field of Search ..... 482/44, 45, 46, 482/47, 49, 121, 123, 124, 128, 905, 908; 601/33, 34, 40; 602/21, 22; 73/379.02, 379.03

[56] References Cited

U.S. PATENT DOCUMENTS

| | | | |
|---|---|---|---|
| 496,094 | 4/1893 | Peloquin . | |
| 3,421,760 | 1/1969 | Freeman, Jr. . | |
| 3,563,542 | 2/1972 | Wellman . | |
| 4,007,623 | 2/1977 | Shillinger, Jr. | 73/12.04 |
| 4,343,465 | 8/1982 | Allen . | |
| 4,836,531 | 6/1989 | Niks . | |
| 4,844,448 | 7/1989 | Niznik . | |
| 5,005,831 | 4/1991 | Hara . | |
| 5,048,825 | 9/1991 | Kelly . | |
| 5,072,927 | 12/1991 | Santos . | |

*Primary Examiner*—Richard J. Apley
*Assistant Examiner*—Jeanne M. Clark
*Attorney, Agent, or Firm*—Gunn, Lee & Miller, P.C.

[57] ABSTRACT

An exercise device comprising a housing with walls, a lever rod with a spring attached to one end, a movable fulcrum and a second end for attaching a device to couple the second end with the hand or arm of the user. Movement of the hand or arm will be transmitted through the movable fulcrum to the spring to provide resistance against which to exercise.

6 Claims, 12 Drawing Sheets

ARM, HAND AND WRIST EXERCISING DEVICE

This application is a continuation-in-part of U.S. patent application Ser. No. 08/135,894 filed Oct. 13, 1993, now U.S. Pat. No. 5,380,259 issued Jan. 10, 1995.

FIELD OF THE INVENTION

A wrist, finger, hand, and arm exercising device, more particularly an exercising device having a movable fulcrum, the fulcrum operating against a lever rod with a bias means at one end, the lever for applying a resisting force at the other end.

BACKGROUND OF THE INVENTION

There are approximately eight million (8,000,000) hand and wrist injuries each year. These range from minor sprains and bruises to major fractures, partial paralysis, burns, and deformation. Included in these are injuries or diseases of the spinal cord that affect movement of these extremities.

Because of the anatomical complexity of the wrist area, rehabilitation of the forearm, hand and wrist are often lengthy and must be carefully monitored. A number of devices have been disclosed in the prior art which are specifically designed to rehabilitate the forearm, wrist, hand and fingers. None, however, offer the versatility of being able to perform a number of different exercises to the forearm, wrist, hand and finger region while maintaining a physically small size as well as a mechanically simple construction.

Here, applicants have provided a device designed to accommodate a wide range of exercise needs to strengthen the wrist, hand, fingers or arm. Applicants' device allows an adjustable, quantifiable degree of resistance needed to improve strength and/or flexibility.

Applicants' device provides for a standard housing attachable to a table, chair or other mounting surface. The standard housing is made up of sidewalls with a spacer block at both ends. A movable fulcrum is mounted to the housing sidewalls and engages a lever rod which is spring loaded at one end. The sidewalls also support an arm rest. The removed end of the lever rod has a biased means such as a light, medium or heavy weight spring (depending upon the particular exercise needs). The removed end of the lever rod is provided with various attachments which allow the standard housing to be used in conjunction with the various attachments to provide simple, quantifiable, mechanical and adjustable exercise means to the arm, wrist, hand and fingers.

The various attachments can be quickly changed out for different exercises without the patient having to move. This saves valuable therapy time and makes the device advantageous for use in rehabilitation facilities.

Fulcrum adjustment provides a wide range of resistance, the range further expandable depending upon the weight of the spring used and the position of the fulcrum. In addition, the arm rest has an adjustment for moving forward and backward, as well as pivoting with respect to the housing sidewalls. These adjustments may be required for the many different exercises capable with the various attachments to the standard housing.

Applicants' device has been carefully designed to bring an appropriate level of sophistication to the different phases of the post-injury rehabilitation process. Never before has there been a practical, comprehensive set of tools to follow a patient recovering from a wrist or hand injury during hospitalization through to completion of the rehabilitation. Quite often, after initial in-patient rehabilitation, a point is reached when the patient has recovered sufficiently that intensive and expensive therapy can no longer be justified. At this point, however, the therapy is usually not complete and the patient has not fully recovered. This can be a critical time. If not fully recovered, a patient is not only vulnerable to re-injury but, without a comprehensive program, may never fully recover. After initial hospitalization, the patient is usually either referred to out-patient therapy (which is also quite expensive) or is given instructions to continue exercises at home.

Rehabilitation hospital patients are usually rehabilitated on complex, institutionally-oriented machines. Applicants' device, while suitable for use in an institution, is able to follow the patient home in its many versions, adapting to the many different and specific needs of individual patients. Not only can the patient benefit from having home access to a proper and diversified exercise device after initial discharge from rehab, the health care industry and insurance companies will save valuable resources by being able to significantly reduce the therapist-supervised, outpatient therapy.

OBJECTS OF THE INVENTION

It is the object of this invention to provide for a simple, mechanical, compact and standard housing device for exercise and rehabilitation of the arm/wrist/hand and fingers, which device is mountable in a variety of positions to a mounting surface and which is capable of accepting a variety of attachments capable of a variety of arm/wrist/hand/finger rehabilitation exercises.

SUMMARY OF THE INVENTION

This and other objects are provided for in an exercise device comprised of a standard housing with sidewalls to which is adjustably mounted a sliding fulcrum and a pivoting lever rod, one end of the lever rod being attached to bias means such as a coil spring, with the other end of the bias means or coil springs attached to the sidewalls of the housing. The removed end of the lever rod provides a point to attach various attachment accessories. An arm rest is adjustably mounted to the sidewalls in which to receive the forearm of the user. Typically, the hand of the user will grasp the attachment accessory which will provide resistance to the user's exercise effort.

BRIEF DESCRIPTION OF THE DRAWINGS

FIG. 3 illustrates first engagement means attached to the removed end of the lever rod.

DETAILED DESCRIPTION OF THE PREFERRED EMBODIMENT

Figure 1:
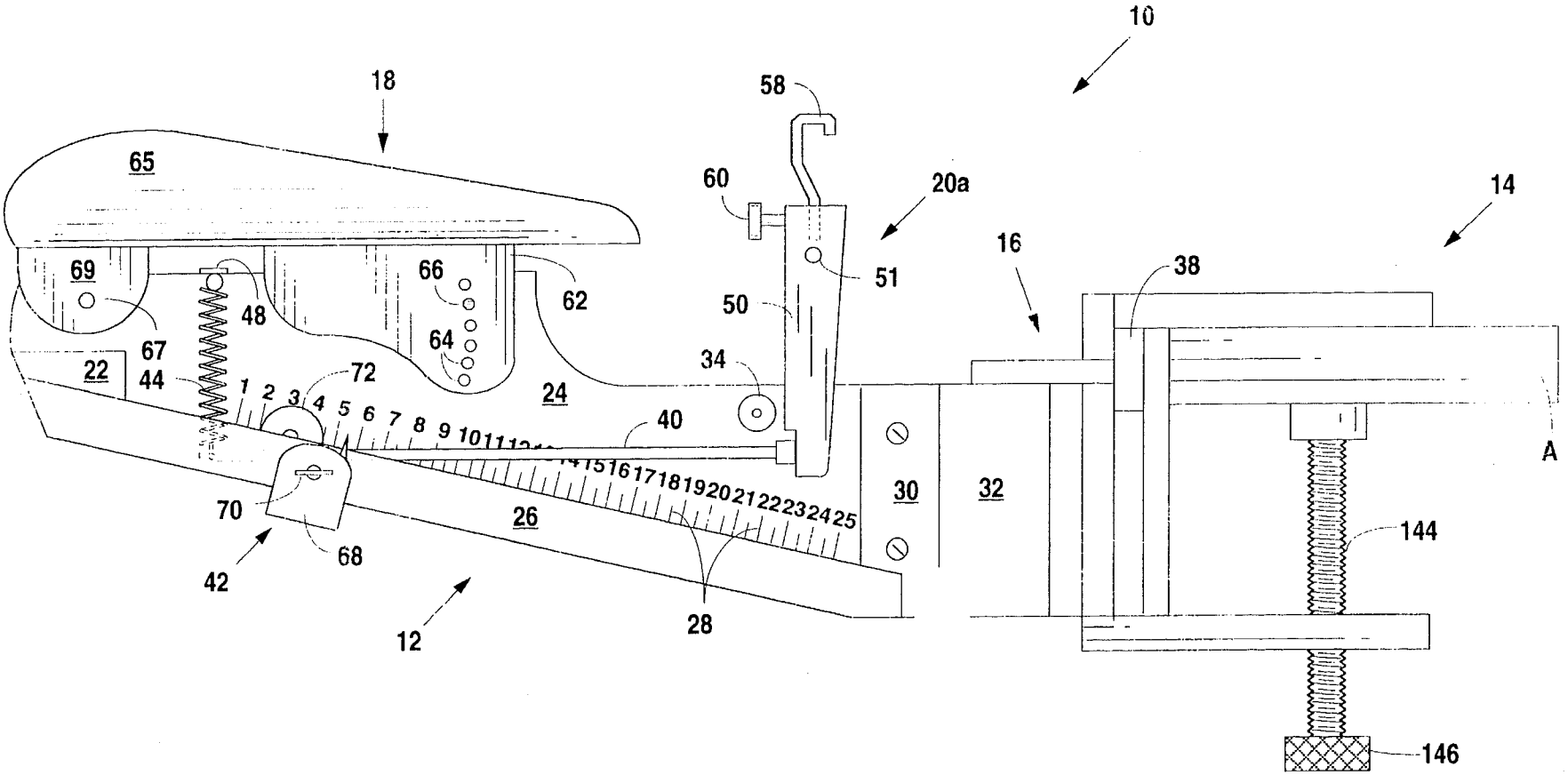
FIG. 1 is a side elevational view of the exercising device illustrating the standard housing to which is attached first engagement means, the device being mounted to a table "A".

At the outset it is helpful to refer to FIG. 1 and understand that applicants' exercising device (10) is comprised of a standard housing (12) which may be adjustably mounted to a table (A) or other mounting platform via a mounting bracket (14). The use of a mounting arm (16) on housing (12) allows engagement with mounting bracket (14) as illustrated in FIG. 1. As can be seen in FIG. 1 mounting arm (16) is "T" shaped with the arms of the "T" engageable with a "T" channel slot in mounting bracket (14), as more particularly set forth below.

Figure 1A:
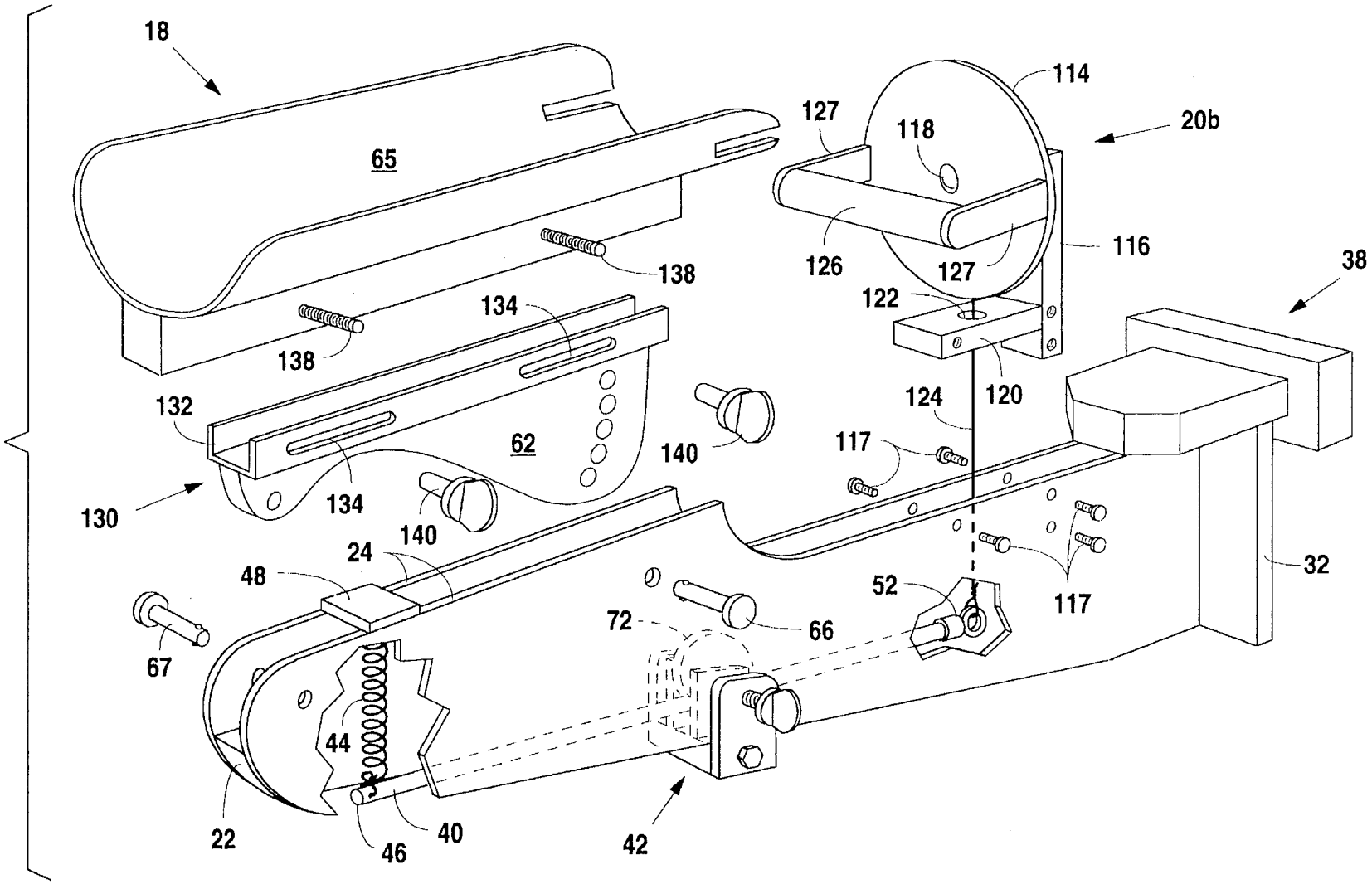
FIG. 1A is an isometric view of the exercising device of applicants' invention featuring second engagement means and an alternate preferred embodiment to the arm rest.
Figure 4:
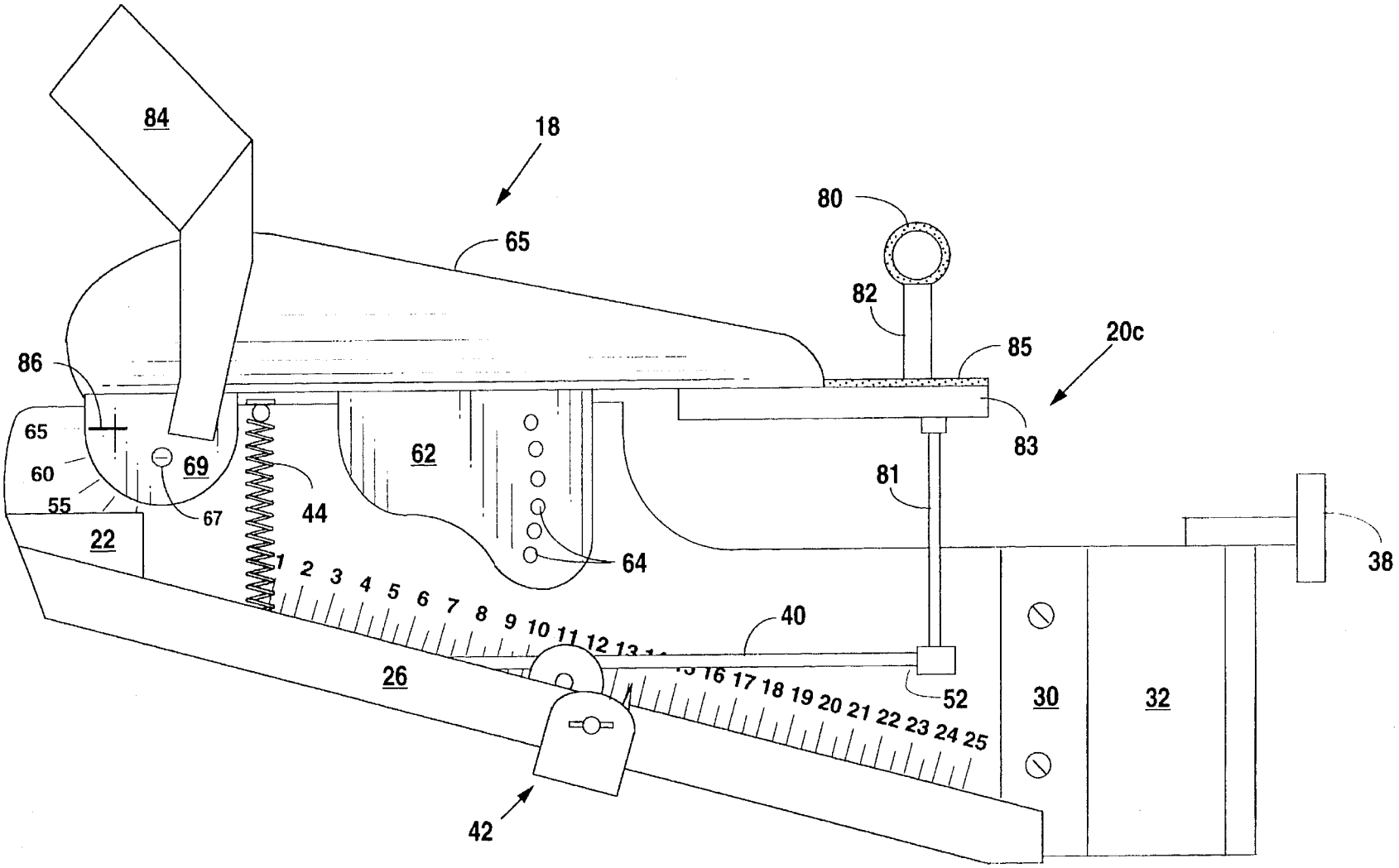
FIG. 4 is a side elevational view of the standard housing of applicants' exercise devise to which is attached third engagement means.
Figure 5:
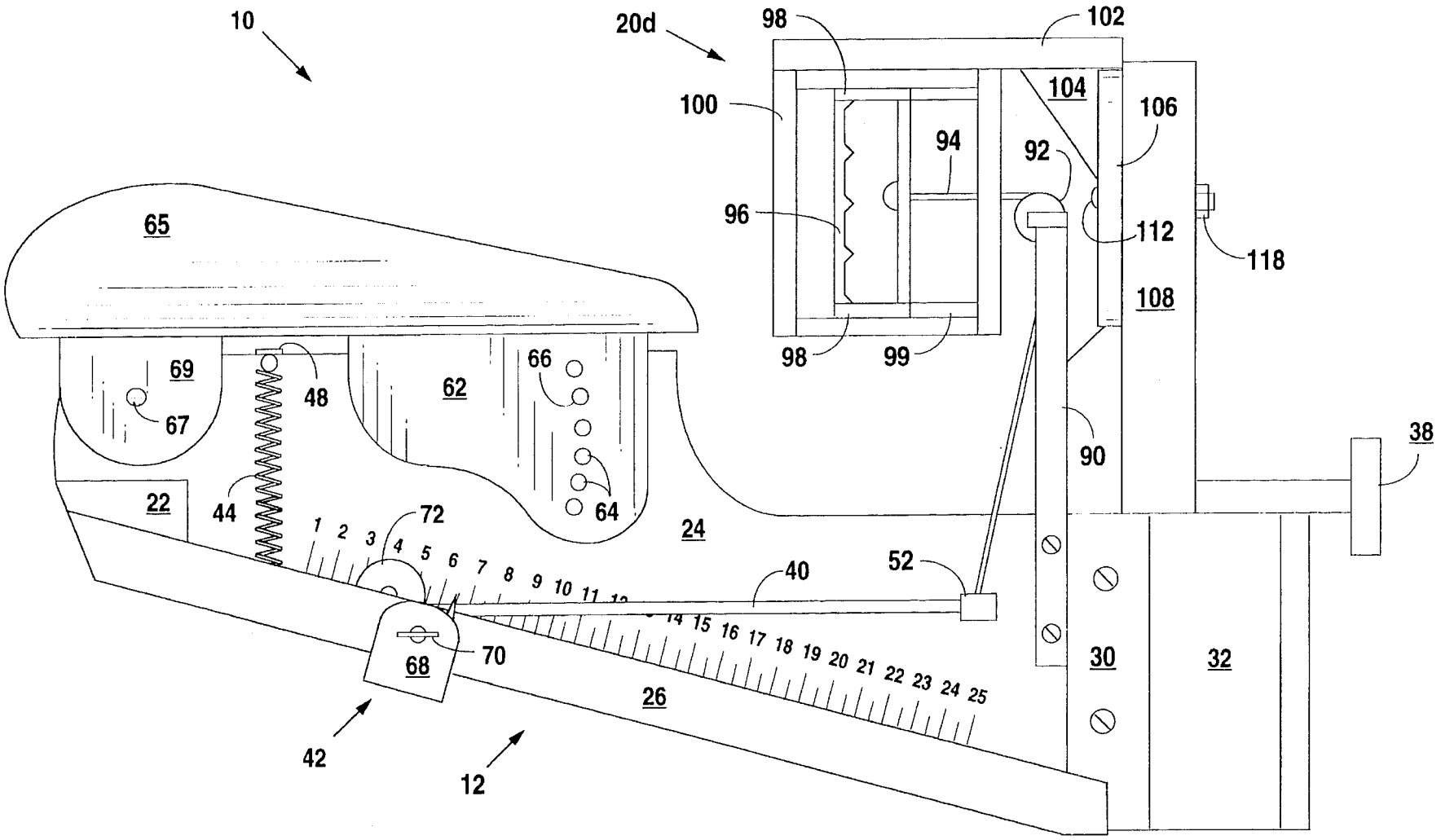
FIG. 5 is a side elevational view featuring the standard housing of applicants' present invention as well as fourth engagement means.

An arm rest (18) is comprised of a surface concave shaped to provide support to the forearm of the user. The user's hand will extend forward of arm rest (18) for contact with first engagement means (20*a*). FIGS. 1A, 4 and 5 illustrate additional engagement means.

Figure 2:
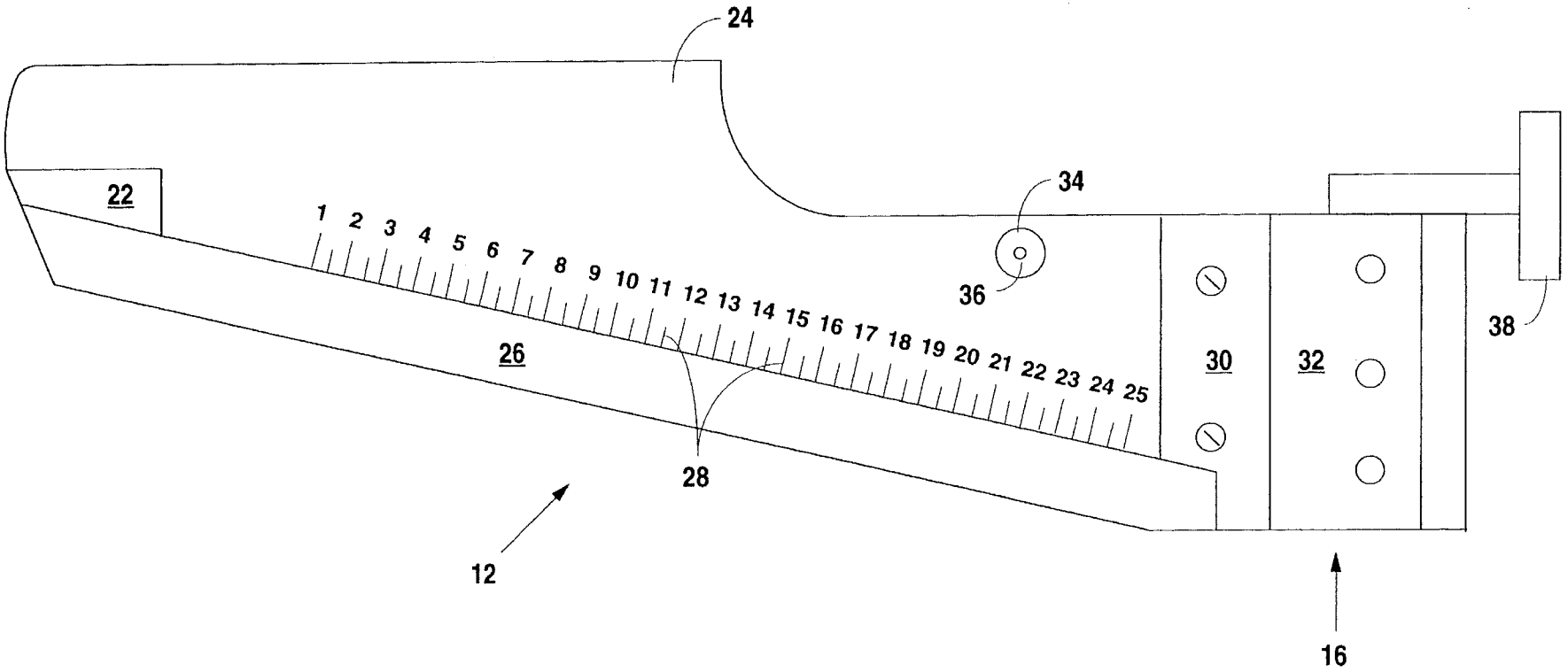
FIG. 2 is a side elevational view of the standard housing of applicants' excise device, without the arm rest, lever rod, spring, engagement means or sliding fulcrum.

With reference to FIGS. 1, 1A and 2 it is seen that housing (12) is comprised of a pair of sidewalls (24) identically shaped, typically made of clear lucite or plastic type and held apart by end-mounted spacing blocks (22) (near end) and (30) (far end). Housing guards (26) (removed from FIG. 1A to detail other structure), typically made from sheet aluminum and attached to- the lower diagonal border of sidewalls (24), are provided for engagement with a sliding fulcrum (42) (see FIG. 1). Indicia (28) is provided near the lower edge of sidewalls (24) and adjacent housing guard (26), to provide a means of quantifiably comparing resistance provided by exercise device (10) when in use. A coupling block (32) is fastened to the sidewalls (24) by typical fasteners such as screws or nuts and bolts or the like. Attached to coupling block (32) is "T" block (38) for engagement with mounting bracket (14) as move specifically set forth in FIG. 1 and FIG. 10.

Figure 3:
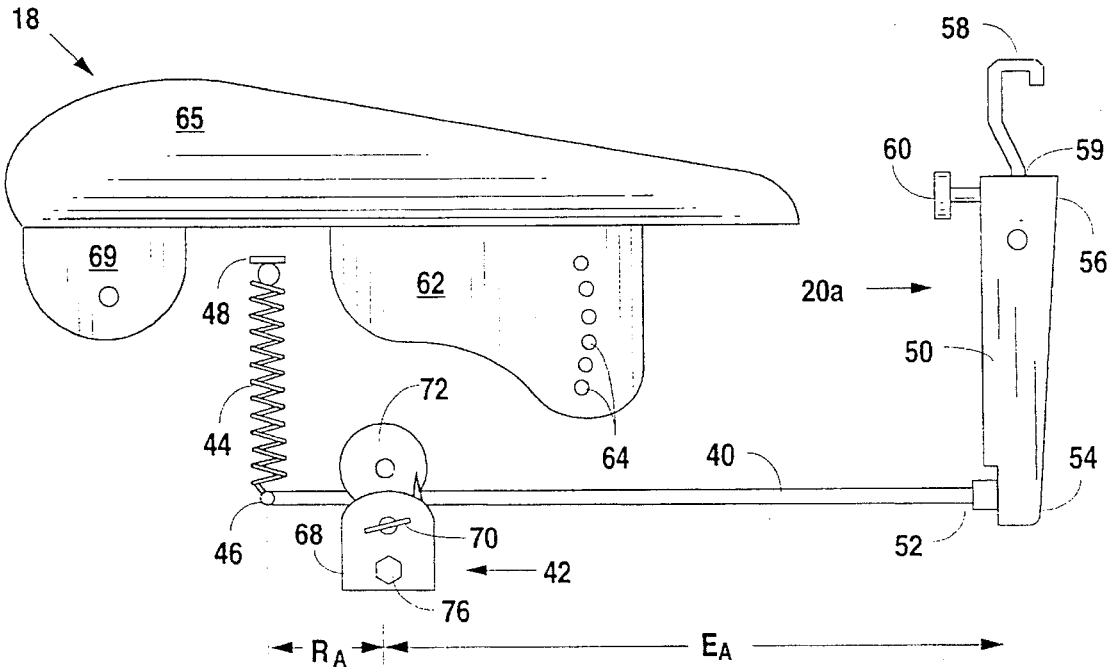
FIG. 3 is a side elevational view of the arm rest, lever rod, spring and sliding fulcrum of applicants' present invention which, together with the elements illustrated in FIG. 3 comprise the standard housing of applicants' exercise device. Additionally.

To help maintain an appropriate angular relationship with first engagement means (20*a*), guide means such as a wooden roller (34) mounted to a pin (36) between sidewalls (24) will be provided. This is especially useful when using exercise device (10) with first engagement means (20*a*) as illustrated in FIG. 1 to maintain a proper angular relationship between a lever rod (40) of housing (12) and a guide arm (50) of first engagement means (20*a*) (see also FIG. 3). Turning now to FIG. 3 (and in conjunction with FIGS. 1 and 1A), it is seen how sidewalls (24) of housing (12) enclose a mechanism comprising lever rod (40) engaged with sliding fulcrum (42), which fulcrum is movable between near end (46) and far end (52) of lever rod (40). At near end (46) is attached bias means, typically a spring (44), attached at its second end to side-walls-mounted support plate (48). Far end (52) is attached to first engagement means (20*a*) or one of the other engagement means depicted in and explained in more detail below.

Lever rod (40) is "floating", that is to say, it does not engage sidewalls (24) except at near end and there through spring (44) and again at the sliding fulcrum, which may be positioned along housing guard (26) to selectively increase the amount of resistance afforded by exercise device (10). That is, with reference to FIG. 3, "$R_A$" (resistance arm) and "$E_A$" (effort arm) may be altered by sliding fulcrum (42) along lever rod (40) and across housing guard (26). Assuming the resistance provided by spring (44) is linearly proportional to movement of near end (46 ) (stretch) and responds to movement of far end (52) (effort) then when "$R_A$" equals "$E_A$", the effort force required to move far end (52) will equal the resistance force generated by near end (46). When "$E_A$" is less than "$R_A$", the effort force will be greater than the resistance force. On the other hand, when "$R_A$" is less than "$E_A$", the effort force will be less than the resistance force. Sliding fulcrum (42) may be adjustably set between near end (46) and far end (52) to adjustably select the effort required to move far end (52) thus making the device versatile to a wide variety of needs. Further, springs (44) may be changed out to lighter or heavier duty springs, as required by the particular exercise.

Guide arm (50) engages far end (52). Guide arm (50) is a component of first engagement means (20*a*) and has near end (54) and removed end (56). Removed end (56) contains a hook shaped grip (58) engageable with a slot (59) and held in place with a locking screw (60) at the far end of first engagement means (20*a*). Thus, through grip (58), the user engages portions of his wrist, arm, hand or fingers while laying his forearm in arm rest (18) with first engagement means (20*a*).

Figure 3A:
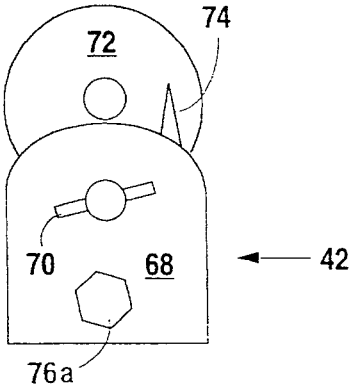
FIG. 3A is a detailed side elevational view of the sliding fulcrum of applicants' present invention, removed from the remainder of the device.
Figure 3B:
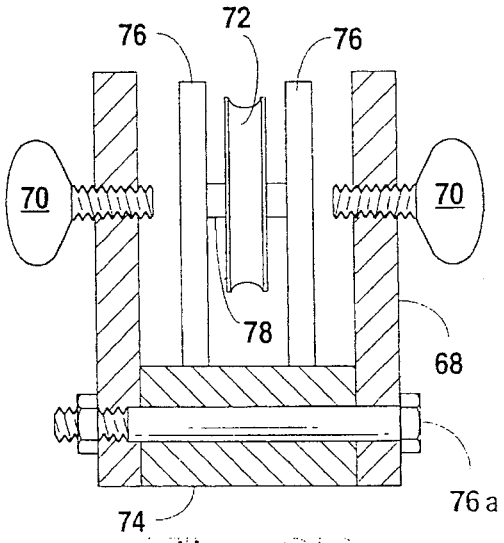
FIG. 3B is a front elevational view of the sliding fulcrum of applicants' present invention, removed from the remainder of the device.
Figure 3C:
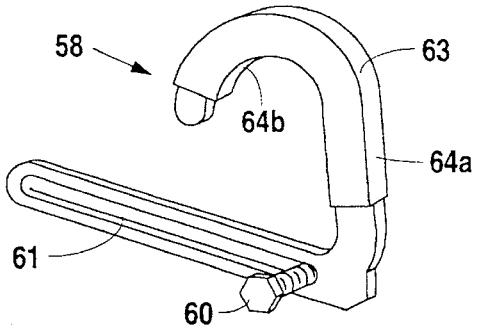
FIG. 3C is an isometric view of the grip of applicants' present invention in a first position.
Figure 3D:
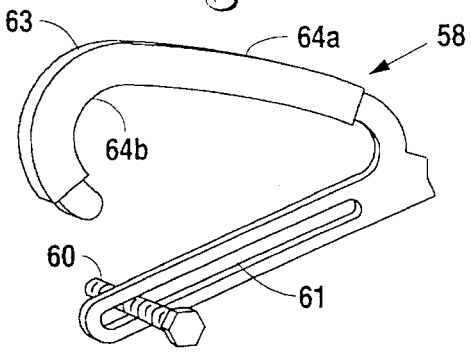
FIG. 3D is an isometric view of the grip of applicants' present invention in a second position.

FIGS. 3C and 3D illustrate, in more detail, grip (58). In particular it is noted that grip (58) is hook-shaped having a diagonal slot (61) for engagement with locking screw (60) of guide arm (50). By loosening locking screw (60), grip (58) can be adjustably set at a variety of angles with respect arm rest (18). Padding (63) is provided as grip (58) is typically metal and may hurt or injure the user.

Leg (64*a*) of grip (58) is straight to allow the user to place his fingers comfortably around it or to allow his palm or the back of his hand to engage it for different exercises. Curved portion (64*b*) of grip (58) typically engages the outside of the index finger or the edges of the user's hand, depending upon the exercise. For example, with grips (58) positioned as illustrated in FIG. 3C, the hand will engage curved portion (64*b*) as the user moves the hand up and down in the plane of the wrist. On the other hand, when positioned as illustrated in FIG. 3D, the user will place either the back of his hand or the palm against straight leg (64*a*) and move the hand up and down perpendicular to the plane of the wrist. The hand grip on the wrist extender attachment (the hook-shaped grip) is unique in that it is designed to be used or engaged during exercise by the back of the hand, this is because quadriplegics often cannot grip with fingers. It works well for wrist extension and wrist flexion. When the hand grip is adjusted to the other end of the slot, it can do the radial deviation exercise.

Turning back to FIG. 3, and with reference also to FIG. 1, it is seen that arm rest (18) is dimensioned to receive the forearm of the user. Arm rest (18) includes a concave-shaped cup portion (65), representing the surface on which the forearm would rest. The inside surface of cup (65) may contain a thin foam pad for comfort. Extending below longitudinal axis of cup (65) is a vertical adjustment guide plate (62) having a multiplicity of adjustments holes (64) therein for receipt of an adjustment pin (66). Rearward from adjustment guide plate (62) and extending downward is support plate (69) which includes a pivot pin (67) for mounting to sidewalls (24).

It is seen in FIG. 1 how arm rest (18) engages sidewalls (24) of housing (12). Specifically, it is seen that arm rest pivot pin (67) engages and mounts arm rest (18) through a hole in plate (69) while being held in sidewalls (24). Pivot pin (67) provides an axle on which plate (69) can pivot. A series of adjustment holes (64) extending through vertical adjustment guide plate (62) allow engagement of adjustment pin (66) with the holes in sidewalls (24) as seen in FIG. 1. By removing and reinserting adjustment pin (66), arm rest (18) may be set at a pre-selected angle with respect to housing (12), depending upon the requirements of the user.

Turning now to the details of sliding fulcrum (42) and with reference to FIGS. 3, 3A and 3B it is seen that sliding fulcrum (42) is comprised of a pair of parallel, spaced-apart, outer side guide plates (68) and an adjustment locking screw (70) (illustrated here on both sides but may be only on one side of fulcrum). Mounted to outer side plates (68) is a fulcrum, illustrated here as a fulcrum wheel (72). Fulcrum wheel (72) is mounted to a pair of parallel, spaced-apart sidewall-engaging inner side guide plates (76) by means of axle (78). A base block (74) and fasteners (76*a*) complete the structure of sliding fulcrum (42). The use of two rotatable adjustment locking screws (70) on the sides of sliding fulcrum (42) will, when tightened against housing guards (26), fix sliding fulcrum (42) along sidewalls (24) when the appropriate resistance has been selected by the user.

Turning now to FIG. 4 it is seen that third engagement means (20*c*) attaches to far end (52) of lever rod (40) to provide resistance to a user. More specifically it is seen how third engagement means (20*c*) is comprised of an extension arm (81) engageable with far end (52) of lever rod (40). The removed end of extension arm (81) is attached to a platform (83) which typically is made of metal and covered with a padding (85). Extending vertically from a side edge of platform (83) is a support arm (82) on which is perpendicularly mounted a padded hand grip (80). In this embodiment, arm rest (18) has been modified with the addition of an upper arm holder (84) attached to either side of arm rest (18). Cup (65) has platform (83) extending forward therefrom providing support to the hand or the fingers holding padded grip (80) as the upper arm rests against upper arm holder (84). Resistance then may be applied to far end (52) of lever rod (40) in an upward direction as viewed in FIG. 4. Spring (44) provides resistance to such movement in same manner as set forth earlier.

In the rehabilitation of some cervical spinal cord injuries, it becomes necessary (for the maintenance of full range of motion of the elbow) for the therapist to initiate a regular stretching regime for the patient. This frequently happens, because many quadriplegics will lose control of the tricep muscle and not the bicep muscle. The bicep then keeps the elbow bent, eventually resulting in the loss of range of motion.

Similarly, burn patients can lose range of motion of the elbow. After being burned, the skin loses its elasticity. Also, tendon damage may have occurred, causing loss of range of motion.

Various other injuries can also result in a tight elbow tendon, for instance, an arm that has been broken and been in a cast for weeks will need stretching.

The elbow attachment for the system, seen here as engagement means (20*c*), addresses these needs.

FIG. 5 illustrates the manner in which fourth attachment means (20*d*) is comprised of a pulley mount arm (90) which mounts adjacent to spacer block (30) and between sidewalls (24). Pulley mount arm (90) may also be attached to sidewalls (24) by screws, bolts or other fastening means. A cable (94) is attached to far end (52) of lever rod (40), around pulley (92), and to sliding finger grip (96). Finger grip (96) rides on guide tracks (98) overlapping stationary ridges (99). Finger grip (96) is movable with respect to a bracing bar (100). Both guide tracks (98) and bracing bar (100) are mounted to arm (102) which, in turn, is supported by a corner brace (104) to a disk-shaped, axle-mounted rotation wheel (106). Rotation wheel (106) in turn is rotatably mounted by centrally located rotation wheel axle locking bolt (112) on support arm (108). Support arm (108) in turn is mounted to coupling block (32).

Fourth engagement means (20*d*) thus provides for an attachment with which the user may rest his arm in cup (65) and place his thumb and/or a portion of his palm against bracing bar (100). By wrapping fingers around finger grip (96) and squeezing his fist closed, cable (94) will transmit the tightening force to removed end (52) of lever rod (40) to provide resistance. Note that movement of rotation wheel (106) 90 degrees to either side of the position illustrated in FIG. 5 will allow the same exercise to be performed except with the hand perpendicular to the position it would be in as illustrated in FIG. 5.

Figure 6:
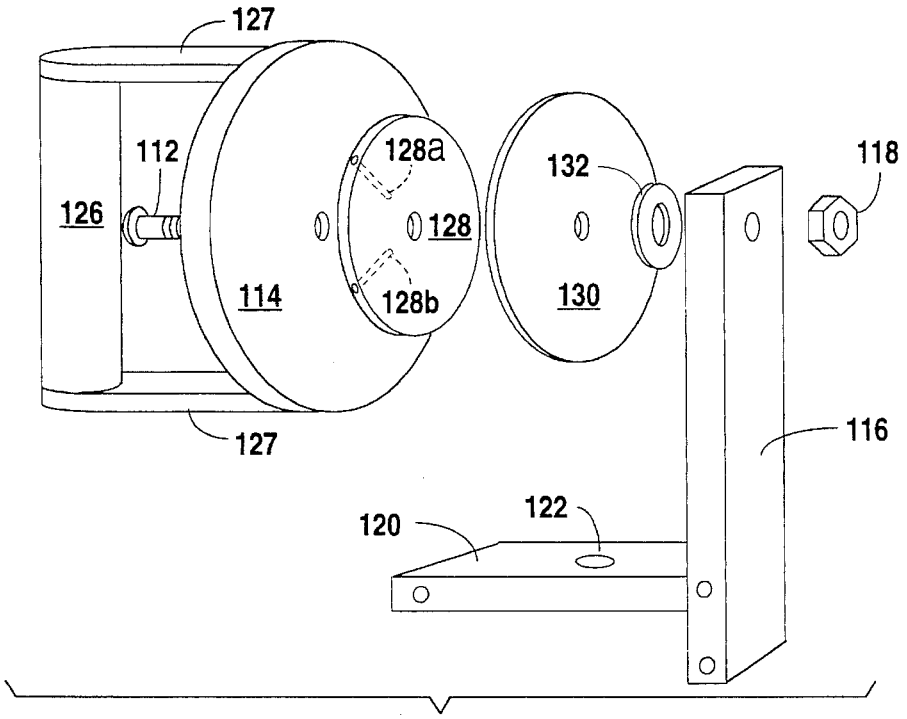
FIG. 6 is an exploded side view in perspective showing the fourth engagement means of applicants' present invention.
Figure 7:
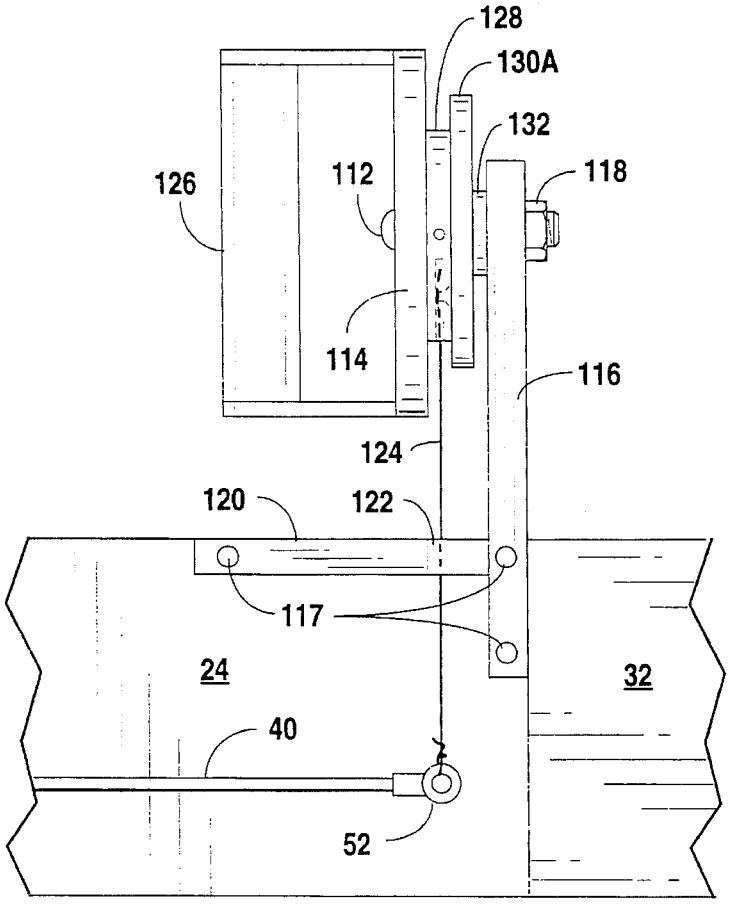
FIG. 7 is a side elevational view of the fourth engagement means of applicants' present invention.

FIGS. 1A, 6 and 7 illustrate second attachment means (20*b*). Attachment means (20*b*) is provided to allow exercising of the muscles that rotate the wrist. Attachment means (20*b*) includes a rotating disk (114) attached to a mounting means (116) for mounting via fasteners (117) to sidewalls (24) of housing (12) . Rotating disk (114) is mounted on an axle (118) so that it may rotate freely with respect to mounting means (116). Mounting means (116) includes a perpendicular mounted base block (120) with a hole (122) centrally located therethrough. A handle (126) attached by arms (127) to the perimeter of rotating disk (114) allows the user to grip and rotate disk (114). A cable (124) attaches to far end (52) of lever rod (40) and extends up through hole (122) and is anchored to the perimeter of disk (128) at either of slots (128*a*) or (128*b*) which is, in turn, rigidly mounted to the rear surface of rotating disk (114). A second disk (130), larger in diameter than disk (128) is provided to sandwich disk (128) between disk (130*a*) and rotating disk (114) in the manner illustrated in FIGS. 6 and 7. Disks (114), (128) and (130*a*) all move together as a unit. Washers (32) complete the basic structure of second attachment means (20*b*).

In use, second attachment means (20*b*) will allow the user to rest his forearm in arm rest (18) and grip handle (126). By rotating handle (126), cable (124) will transfer rotational torque applied to the perimeter of disk (128) through hole (122) to far end (52) of lever rod (40), allowing the far end to rise and fall in response to the rotation of handle (126). Sliding fulcrum (42) along sidewalls (24) will adjust the effort required to move lever rod (40) as set forth above in more detail and allow the user to vary the torque required to rotate disk (114).

Figure 8B:
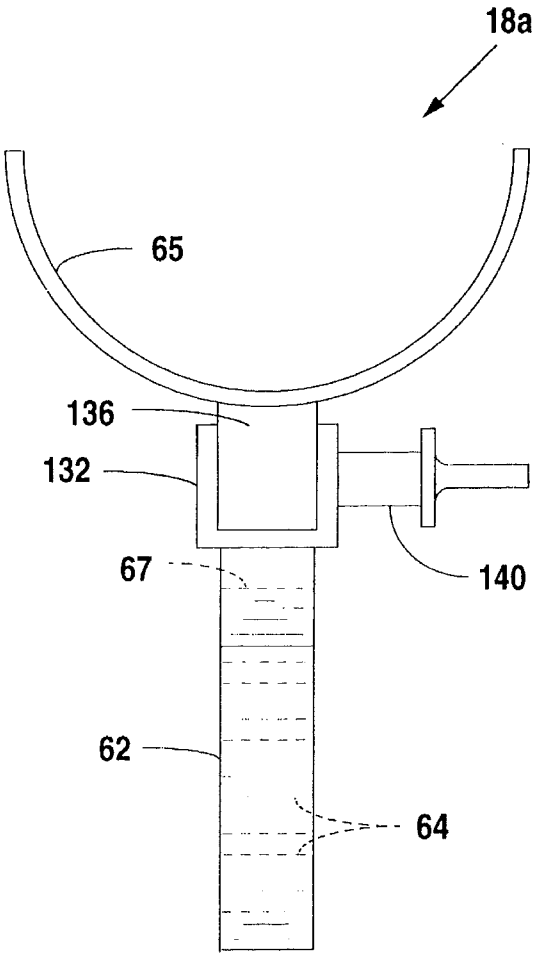
FIGS. 8A and 8B are side isometric and front elevational views (respectively) of the longitudinally-adjustable arm rest of applicants' invention.
Figure 8A:
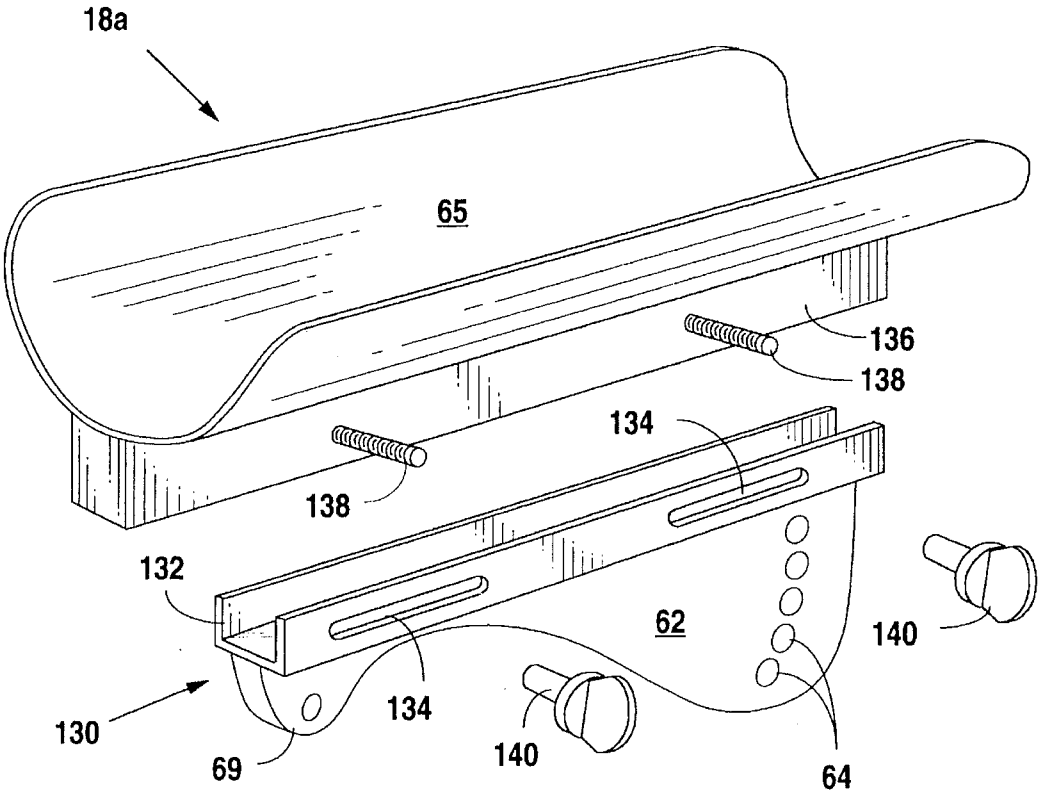

FIGS. 8A and 8B represent isometric and front elevational views respectively of an alternate embodiment of arm rest (18*a*). Still present in an alternate embodiment of arm rest (18*a*) is cup (65), vertical adjustment guide plate (62), adjustment holes (64) and pin (66) (see FIG. 1). Likewise, arm rest pivot pin (67) and plate (69) are the same as previously described. However, between cup (65) and plate (69) and vertical adjustment (62) lies longitudinal adjustment means (130). Longitudinal adjustment means (130) allows cup (65) to be moved longitudinally with respect to plate (69) and adjustment guide plate (62). Specifically, longitudinal means (130) is comprised of a channel (132) having slots (134) in the longitudinal walls thereof. Channel (132) is integral with plate (67) and adjustment guide plate (62) along the top surface thereof. It is dimensioned to receive a guide bar (136) located longitudinally along the bottom surface of cup (65). Threaded studs (138) extend laterally outward from guide bar (136) through slots (134). Female thumbscrews (140) rotatably engage threaded studs (138) such that when the proper longitudinal position of cup (65) is found with respect to plate (69) and adjustment guide plate (62), female thumbscrew (140) can be tightened so as to exert a compressive force urging walls of channel (132) against walls of guide bar (136). Thus longitudinal adjustment means (130) provides a mechanism for sliding arm rest (18*a*) a variable distance with respect to attachment means (20*a*), (20*b*), (20*c*) or (20*d*) as the case may be.

Figure 9:
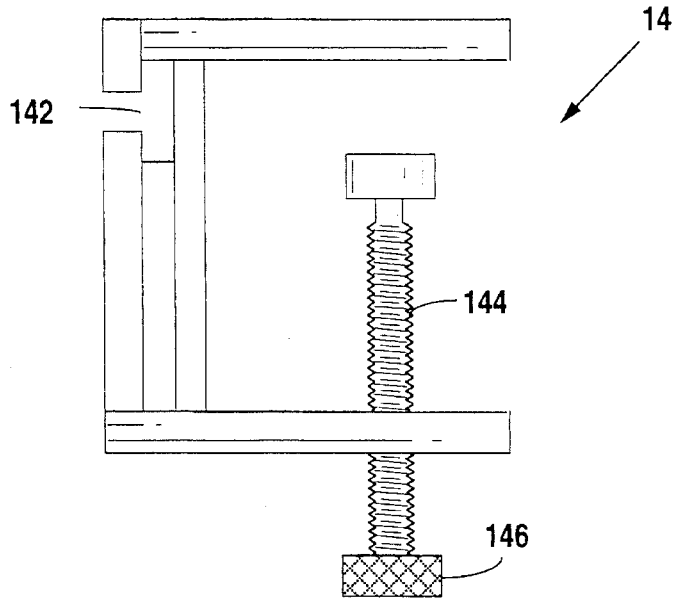
FIG. 9 is a side elevational view of mounting brackets for mounting the standard housing.

FIG. 9 discloses mounting bracket (14) for engaging coupling block (32) of housing (12). Mounting bracket (14) contains walls defining T-shaped channel (142) into which to receive coupling block (32). Threaded bolt (144), threadably attached to walls of mounting bracket (14) may be rotated by knurled knob (146) to tighten against table (A) as shown in FIG. 1.

Figure 11:
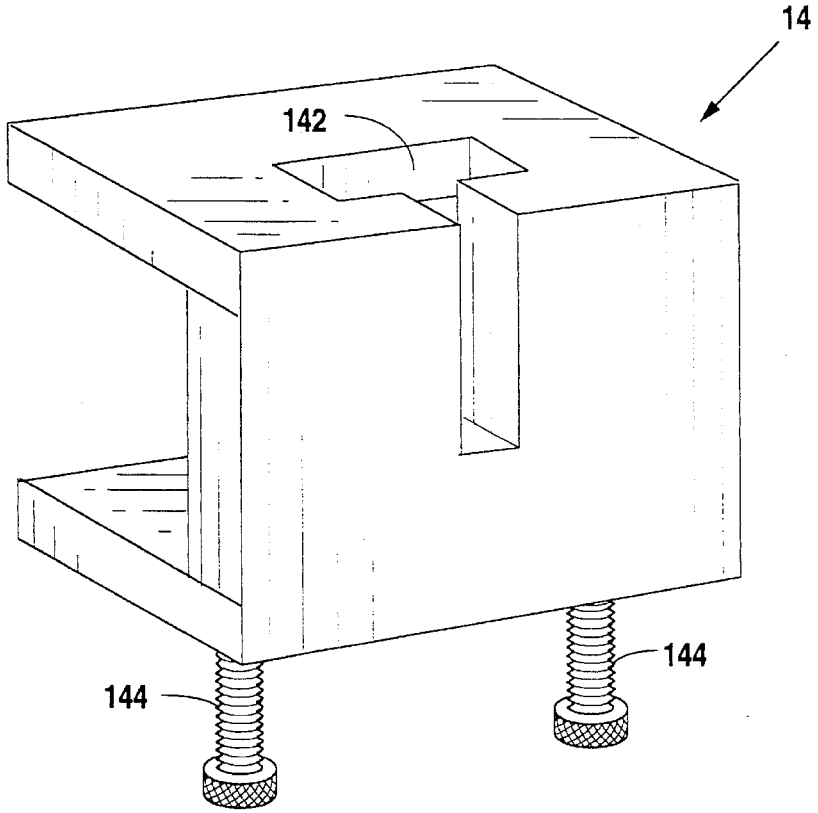
FIG. 11 is an isometric view of an alternate embodiment of a mounting device for the housing of applicants' invention.
Figure 10:
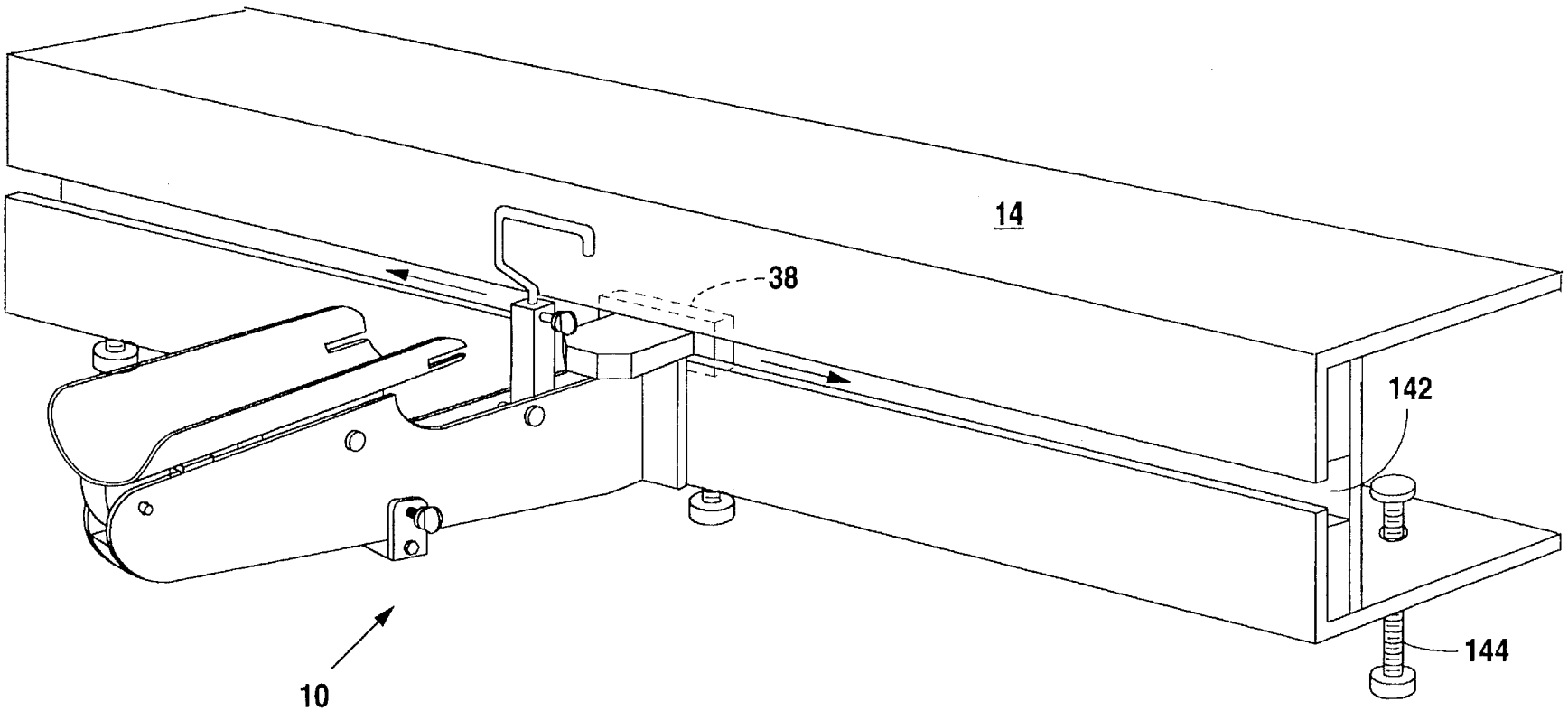
FIG. 10 is an isometric view of a mounting bracket for mounting the housing of applicants' device.

FIG. 10 illustrates an elongated mounting bracket (14) into which a multiplicity of units may be attached by sliding "T" shaped mounting arms through "T" channels (142) FIG. 10 illustrates an alternate preferred embodiment of mounting bracket (14) which has threaded bolts (144) for tightening against table (A) as set forth above. However, in the alternate preferred embodiment illustrated in FIG. 11, walls defining "T" channel (142) are such that the "T" channel is vertical for positioning housing (10) on the table perpendicular to the position illustrated in FIG. 1.

Figure 12A:
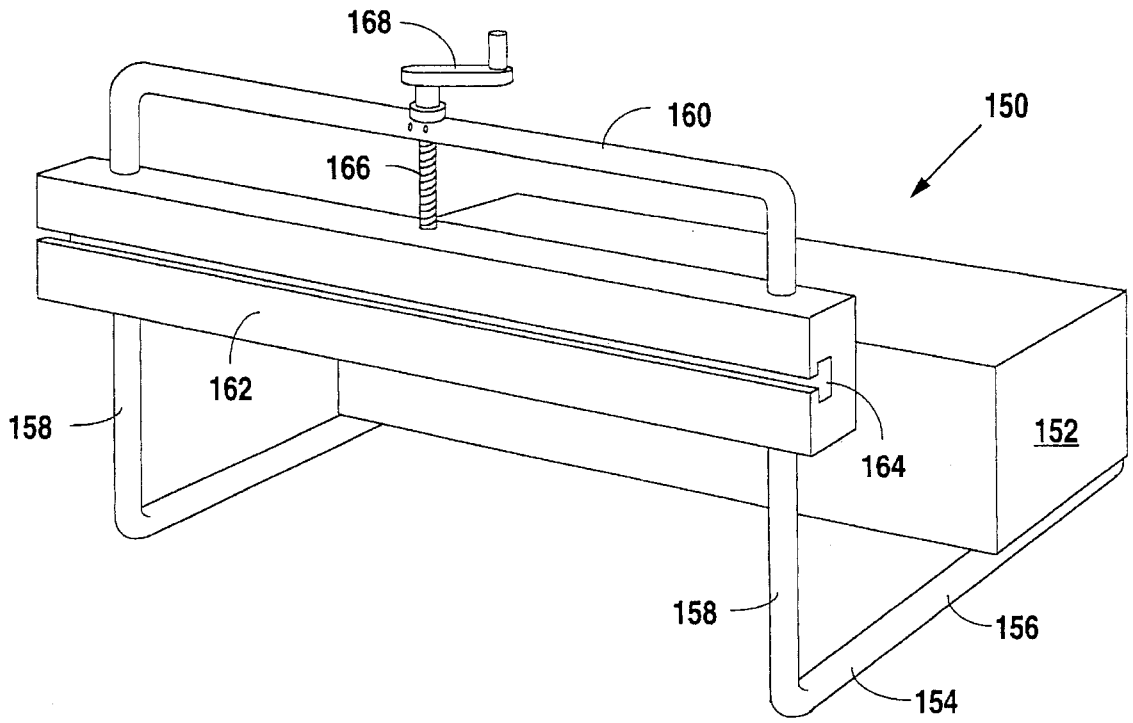
FIG. 12A is a perspective view of a mounting stand for mounting the housing of applicants' invention.
Figure 12B:
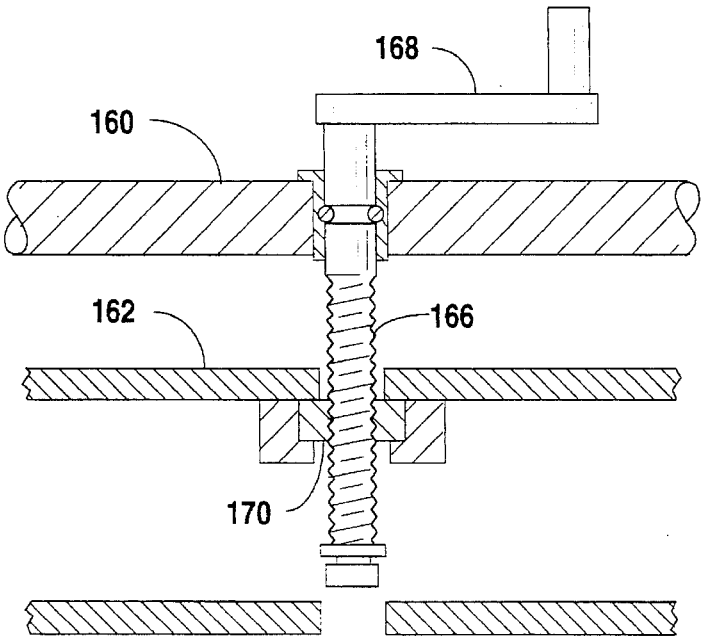
FIG. 12B is an elevational view through A–A' of part of the mounting stand for mounting the housing of applicants' invention.

FIGS. 12A and 12B illustrate a free-standing, mounting device 150. Free-standing device (150) provides a means for mounting applicants' device (10) so that the vertical distance between the floor and the device may be varied. Specifically, FIGS. 12A and 12B illustrate a mounting device (150) having a counterweight (152) mounted to a frame (154). The counterweight may be walls defining a storage compartment for storing these devices. Counterweight (152) is located at a removed end of frame (154). Frame (154) has base arms (156) for laying on the floor for support. Perpendicular to base arms (156) are mounting arms (158). Top bar (160) attaches between removed ends of mounting arms (158). Mounting bar (162) extends between arms (158) and contains "T" channel (164). Receipt of the "T" block of exercise device (10) within "T" channel (164) in sliding fashion allows one or more of the devices to be mounted to bar (162). Adjusting screw (166), having crank (168) at one end thereof and extending through threaded mount (170) of bar (162), allows bar (162) to be adjustably mounted with respect to the floor on which frame (154) lies.

Figure 13:
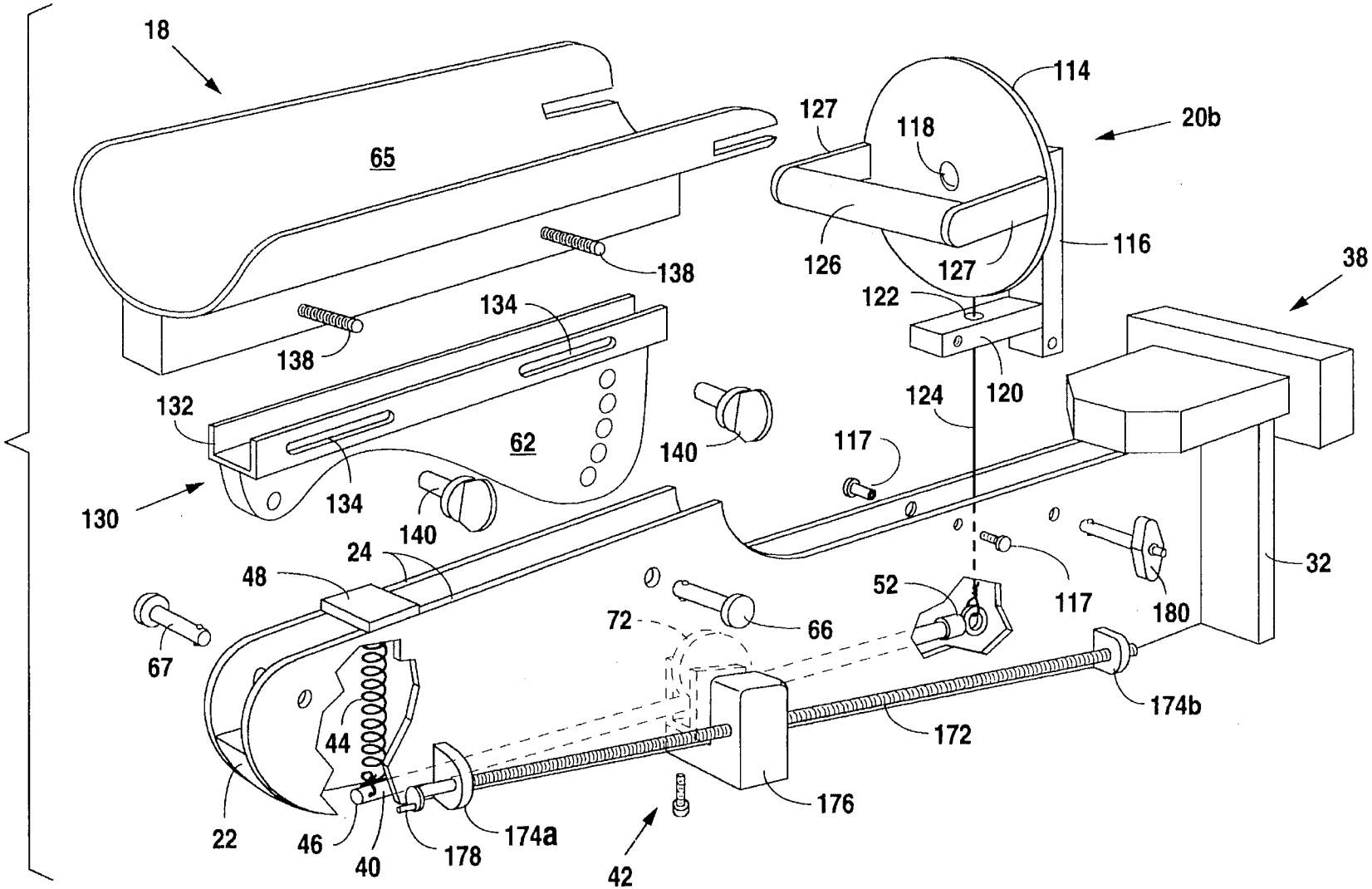
FIG. 13 is a perspective view of an alternate preferred embodiment of applicants' invention.

FIG. 13 illustrates an alternate preferred embodiment of applicants' present invention including a rotatable threaded rod (172) rotatably attached at support mounts (174*a*) and (174*b*) to the housing. The threaded rod includes an adapter (176) which movably engages the fulcrum to allow positioning of the fulcrum between the near end and the far end of the lever rod by rotating handle or knob (178). The use of the threaded rod allows for easy sliding and an accurate positioning of the fulcrum along the lever rod. Further, FIG. 13 illustrates the use of ball-lock pins (180) or other toolless attachment means in place of nut and bolt fasteners. Use of the ball-lock pins makes for easy, quick, toolless insertion and removal and can be provided for at other suitable locations in applicants' device, for example, for attaching cable (124) to far end (52). Thus, it becomes easier to attach and detach the various accessories to applicants' housing.

Terms such as "left," "right," "up," "down," "bottom," "top," "front," "back," "in," "out," and like are applicable to the embodiments shown and described in conjunction with the drawings. These terms are merely for purposes of description and do not necessarily apply to the position or manner in which the invention may be constructed for use.

Although the invention has been described in connection with the preferred embodiment, it is not intended to limit the invention's particular form set forth, but on the contrary, it is intended to cover such alternatives, modifications, and equivalences that may be included in the spirit and scope of the invention as defined by the appended claims.

What is claimed is:

1. An exercise device comprising:

a housing with sidewalls;

an arm rest with a near end and a far end, the arm rest attached to the sidewalls near the top of the housing;

a lever rod having a near end and a far end, a fulcrum for engaging said lever rod between the near end and the far end thereof, said fulcrum moveable along the bottom edge of the sidewalls of said housing, bias means, engageable with the near end of said lever rod and said housing, including means to selectively locate said fulcrum between the near end and the far end of said lever rod, and means attachable to the far end of said lever rod for engagement with an extremity of the arm of the user for moving said far end of said lever rod against the resistance of said bias means by pivoting said lever rod at said fulcrum.

2. The exercise device of claim 1, wherein said means to locate comprises an at least partially threaded rod rotatably mounted to said housing and engaging said fulcrum to position said fulcrum between the near end and the far end of said lever rod.

3. The exercise device of claim 1 further comprising means to quickly release said attachable means to the far end of said lever rod without the use of tools.

4. The exercise device of claim 3, wherein said quick release means further comprises a ball lock pin.

5. The exercise device of claim 1, wherein said housing is comprised at least in part of polished aluminum.

6. The exercise device of claim 1 further comprising means to selectively locate said fulcrum between the near end and the far end of said lever rod, said means to locate comprising an at least partially threaded rod rotatably mounted to said housing and engaging said fulcrum to position said fulcrum between the near end and the far end of said lever rod; and means to quickly release said attachable means to the far end of said lever rod without the use of tools.

* * * * *